US007364283B2

(12) United States Patent
Nakajima

(10) Patent No.: US 7,364,283 B2
(45) Date of Patent: Apr. 29, 2008

(54) UV CURABLE INK PACKAGE

(75) Inventor: Atsushi Nakajima, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 351 days.

(21) Appl. No.: 11/258,023

(22) Filed: Oct. 26, 2005

(65) Prior Publication Data

US 2006/0092244 A1 May 4, 2006

(30) Foreign Application Priority Data

Oct. 29, 2004 (JP) ..... 2004-315407

(51) Int. Cl.
*B41J 2/175* (2006.01)
*B65D 35/00* (2006.01)

(52) U.S. Cl. ..... 347/86; 222/92

(58) Field of Classification Search ..... 347/86, 347/100; 222/92; 428/34.3, 35.8, 35.9
See application file for complete search history.

(56) References Cited

U.S. PATENT DOCUMENTS 5,849,380 A * 12/1998 Kashiba et al. ..... 428/36.6
6,109,743 A * 8/2000 Takatsugi et al. ..... 347/86
6,223,945 B1 * 5/2001 Giblin et al. ..... 222/109
6,790,875 B2 * 9/2004 Noguchi et al. ..... 522/84

* cited by examiner

*Primary Examiner*—Anh T. N. Vo
(74) *Attorney, Agent, or Firm*—Finnegan, Henderson, Farabow, Garrett & Dunner, L.L.P.

(57) ABSTRACT

An object is to provide an ink package accompanied with an ink bag, that exhibits satisfactory light shielding and ink resistance properties maintaining for a long period of time at low cost against external factors such as vibration and bending, employed via a UV curable ink jet recording method. Disclosed is a UV curable ink package possessing a bag formed with a multilayer and a UV curable ink stored in the bag, wherein the multilayer contains a light shielding layer and an ink resistance layer having a weight changing rate of not more than 1% obtained via an immersion test, employing the UV curable ink that is to be stored in the bag.

9 Claims, 2 Drawing Sheets

UV CURABLE INK PACKAGE

This application claims priority from Japanese Patent Application No. 2004-315407 filed on Oct. 29, 2004, which is incorporated hereinto by reference.

TECHNICAL FIELD

The present invention relates to an ink package and an ink bag employed via a UV curable ink jet recording method.

BACKGROUND

Ink jet recording systems include methods employing respectively various types of ink such as water-based ink, oil-based ink, solvent ink and UV curable ink.

The ink jet recording systems which are of a curable type for actinic radiation such as ultraviolet radiation and EB have been attracting public attention recently, as a method to form images even on a base material having poor ink absorbency. These ink jet recording systems include a solvent type wherein a reactive monomer is diluted with water, water-based solvent or with various organic solvents, and a non-solvent type wherein no solvent remains after hardening. In recent years, non-solvent type ink is attracting public attention with a background in which non-VOC is desired.

As actinic radiation curable type ink which is cured by actinic radiation, there are known radically polymerizable ink composed mainly of an acrylate monomer and cationic polymerization ink composed mainly of an epoxy monomer or an oxetane monomer.

With respect to water-based ink, oil-based ink and solvent ink, many ink bags have been put to practical use, and there have been known structures wherein sufficient durability and storage stability are kept even when using the aforesaid ink.

However, an acrylate monomer, an epoxy monomer and an oxetane monomer which are used for actinic radiation curable type ink show properties which are greatly different from those of dilution solvent used for conventional water-based ink, oil-based ink and solvent ink, resulting in many problems especially in durability and storage stability for a long time, regarding storage of ink. The monomers have properties which are similar to those of plasticizers used as additives for plastic, and the monomers are easily soluble mutually with various plastics. Therefore, if the member which has been used is employed as a member that comes in contact with these ink, it degenerates with actinic radiation curable type ink because it has no ink resistance property, and its functions cannot be exhibited.

Compared with conventional dilution solvents, these monomer components tend to dissolve and swell remarkably the constituting members used for ink bags, which has caused a problem of deformation of ink bags. It has further been found that problems that an ink-jet nozzle is clogged, and that hardening sensitivities by actinic radiation are lowered, are caused, depending on the eluted components. In particular, cationic polymerization ink employing an epoxy monomer, an oxetane monomer or a vinyl ether monomer has caused problems that the ink erodes and swells various plastic members greatly and changes their dimensions and hardness, although the ink has advantages in terms of offensive smells, sensitivities and adhesion properties for a base material, compared with radically polymerizable ink.

Further, ink bags are required to have a light shielding property, because actinic radiation curable type ink is hardened by actinic radiation such as ultraviolet rays.

As a member having an ink resistance property and a light shielding property, there is considered an ink bag employing a metal such as SUS (Stainless Used Steel), which, however, is not practical because of its high cost. Further, depending on a polymerization type, there is sometimes an occasion where storage stability is affected by an amount of air in the ink bag to be deteriorated, as ink is consumed. For example, in the case of radically polymerizable ink, hydrolysis of acrylic ester representing main components is accelerated by moisture carried in from mixed air. Further, in the case of cationic polymerizable ink wherein an acid serves as active species, moisture in minute quantities contained in ink has a function to inhibit dark reaction, mixture of dried air causes a dehydration phenomenon, and dark reaction by an acid component generated slightly is accelerated.

To eliminate an influence of mixed air, a flexible packing material by which a volume of an ink bag can decrease as ink is consumed is appropriate. A specific ink bag is one which employs a sheet in which a flexible film-shaped light shielding member and an ink resistance member are combined, and is packing-heat-sealed while it is decompressed when ink is loaded. By using the flexible packing material, various functions can be offered, cost of an ink bag can be reduced, and waste matters can be reduced.

Therefore, an ink bag made of flexible packing material employing a multilayer laminated film composed of light shielding member of metal film having great light shielding property and of an ink resistance member, was studied, but it was impossible to give sufficient storage stability and durability to the ink bag, under such simple combination.

An ink bag manufactured is housed in an outer box under the condition that the ink bag is supported on a supporter, an ink outlet portion of the ink bag is fixed by the supporter and by the side wall of the outer box and a width of the ink bag is regulated by side walls of the supporter. Therefore, when the ink bag is moved in the course of transportation or of handling, or is vibrated, an ink storage portion of the ink bag is moved back and forth. When the ink storage portion is moved toward the ink outlet portion side, in particular, creases tend to be generated on the ink storage portion, because the ink storage portion results in the state of shrinkage.

After creases are generated once, the creases are easily generated on the same location repeatedly, to be rubbed by the inside wall of the outer box, thereby, pinholes tend to be generated on the location where creases have been generated. When the ink storage portion is made of a multilayer film having therein an aluminum foil layer, in particular, there has been a problem that the multilayer film is easily bent, and its bent portion is rubbed with the inside wall of the outer box to generate a pinhole that lowers light shielding property.

With respect to the light shielding property, Patent Document 1 discloses a proposal wherein a film that attenuates ultraviolet rays is brought into close contact with an ink tank that transmits ultraviolet rays, and the light shielding property and visibility of an amount of residual ink are taken into consideration. However, for the long term storage, this proposal is insufficient because it still has permeability for ultraviolet rays, although a level of the permeability is extremely low.

What is disclosed in Patent Document 2 is one having objects for obtaining mechanical strength of an ink tank member and for restraining an influence of extraction from the ink tank member on the ink. However, it is insufficient for satisfying low cost, light shielding property and ink resistance property. In the case of long term storage or of storage at high temperature, in particular, ink slightly arrives at a light shielding member, and causes a problem of deterioration of a light shielding member and of a decline of adhesion strength between the light shielding member and an ink resistance member.

(Patent Document 1) Japanese Patent O.P.I. Publication No. 2003-182111

(Patent Document 2) Japanese Patent O.P.I. Publication No. 2004-188903

SUMMARY

The above subjects described in the present invention have been studied in consideration of the foregoing situation. It is an object of the present invention to provide an ink package accompanied with an ink bag that exhibits satisfactory light shielding and ink resistance properties maintaining for a long period of time at low cost against external factors such as vibration and bending, employed via a UV curable ink jet recording method.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

BRIEF DESCRIPTION OF THE PREFERRED EMBODIMENTS

Figure 1:
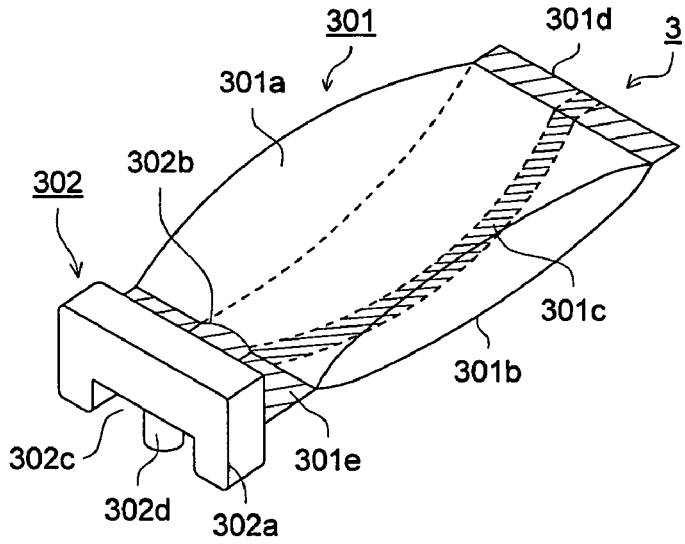
FIG. 1 is an oblique perspective view of the ink bag.

The foregoing object of the present invention is accomplished by the following structures.

(Structure 1) A UV curable ink package possessing (1) a bag formed with a multilayer and (2) a UV curable ink stored in the bag, wherein the multilayer contains (a) a light shielding layer and (b) an ink resistance layer having a weight changing rate of not more than 1% obtained via an immersion test, employing the UV curable ink that is to be stored in the bag.

(Structure 2) The UV curable ink package of Structure 1, wherein a heat sealing layer is provided on an inner surface of the ink resistance layer.

(Structure 3) The UV curable ink package of Structure 1 or 2, wherein the light shielding layer is composed of not less than two layers.

(Structure 4) The UV curable ink package of any one of Structures 1-3, wherein the light shielding layer is an aluminum layer.

(Structure 5) The UV curable ink package of Structures 3, wherein the light shielding layer is composed of two kinds of layers of an aluminum layer and a resin layer containing a light shielding material.

(Structure 6) The UV curable ink package of any one of Structures 1-5, wherein a protective layer containing nylon or polyester is provided on an outer surface of the light shielding layer.

(Structure 7) The UV curable ink package of any one of Structures 1-5, wherein the ink resistance layer contains nylon or polyester.

(Structure 8) The UV curable ink package of Structures 2-7, wherein the heat sealing layer contains polyethylene.

(Structure 9) The UV curable ink package of Structure 8, wherein the foregoing polyethylene is polyethylene prepared by employing a metallocene catalyst.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

After making an effort for intensive studies, the inventors have found out that an ink package accompanied with an ink bag that exhibits satisfactory light shielding and ink resistance properties maintaining for a long period of time at low cost against external factors such as vibration and bending, employed via a UV curable ink jet recording method, can be obtained, and it possesses at least a light shielding layer and an ink resistance layer having a weight changing rate of not more than 1% via an immersion test with a UV curable ink jet ink.

The invention will be explained in detail as follows.

Structure 1 is of a UV curable ink package possessing a bag composed of a multilayer and a UV curable ink stored in the bag, wherein the multilayer contains a light shielding layer and an ink resistance layer having a weight changing rate of not more than 1% obtained via an immersion test, employing the UV curable ink that is to be stored in the bag. Owing to the layer structure wherein a light shielding layer and an ink resistance layer having 1% or less of weight changing rate in the immersion test, swelling of the ink resistance layer is restrained in a long term storage, and generation of pinholes on the light shielding layer can be prevented, even when mechanical deformation such as vibration or bending is caused. In addition, even when mechanical deformation is caused, adhesion properties of the ink resistance layer with the light shielding layer are not deteriorated, because the ink resistance layer is hardly swelled by ink. In the immersion test made in the invention, a test member is put in working ink to be left for one week at 60° C. Weight changing rate before and after the immersion is measured. Incidentally, herein, the above-mentioned UV curable ink package is specified as a package possessing a bag formed with a multilayer and a UV curable ink stored in the bag.

In Structure 2, by providing a heat sealing layer in the Structure stated above, ink can be sealed after it is filled.

Structure 3 is of an ink bag, wherein a light shielding layer is composed of two or more layer. It is very difficult to generate no pinhole on the light shielding layer, and it would result in cost increase if no pinhole is realized. When the light shielding layer is composed of two or more layers, even if a pinhole is generated on one shielding layer, the other shielding layer can shield light.

Structure 4 is of an ink bag, wherein a light shielding layer is an aluminum layer. It is preferable that at least one layer out of light shielding layers is an aluminum layer. Aluminum shows not only excellent light shielding properties but also water vapor barrier property and gas barrier property, which is especially preferable. Aluminum can be provided through vacuum evaporation, but, vacuum evaporation tends to generate pinholes. It is therefore preferable to use an aluminum foil. A thickness of the aluminum foil is 1-30 μm, and it is preferably 5-25 μm. As a type of aluminum, an iron-based aluminum alloy which shows high toughness in the case of refraction is preferable.

An ink bag used in the invention is preferably composed of a material which has light shielding property and has low air-permeability or low moisture-permeability.

Regarding light shielding property, a bag whose transmittance for light is 0-8%, preferably is 5% or less, for a wavelength range of 250-440 nm is preferable on the point that viscosity increasing of ink can be restrained. After putting ink in an ink bag of the invention, it is also possible to put the bag which is filled with ink in a different bag. For example, there are given a cardboard box, a plastic bag and a plastic bag, and it is preferable to keep these bags to be at 8% in terms of light transmittance for a wavelength range of 250-440 nm. Light transmittance for a wavelength range exceeding 440 nm is preferably 8% or less, and it is 5% or less more preferably. These bags may also be those (transmittance is 0%) which completely intercept light in a wavelength range of 250-440 nm.

In general, in a plastic bag of polyethylene used as an ink bag, if it is exposed to the environment of high temperature in the course of long term storage, air or moisture contained in ink fluctuates through a bag for storage, because air-permeability or moisture-permeability is not always small, which affects on ink shelf stability. In cationic polymerizable ink wherein an acid serves as a catalyst, in particular, if the moisture content is lowered, polymerization is accelerated by acids in minute quantities generated in the system, resulting in viscosity fluctuations such as viscosity rise, gelation or viscosity decline.

For long term storage property of polymerizable ink, especially for cationic polymerizable ink employing oxetane, a storage bag made of a material having low moisture-permeability is preferable, in which, even when ambient temperature rises in the course of storage, discharge of moisture contained in the storage bag to the outside is restrained, and shelf stability is improved by the effect of restraining existing moisture, even when acids in minute quantities are generated in the system employing acid-generating agents.

Examples as the material exhibiting low moisture permeability include vinylidene chloride polymer, nylon 11, nylon 12, polychlorotrifluoroethylene, polytetrafluoroethylene, polyether ketone, polyphenylene sulfide, polypropylene, low-density polyethylene (LDPE), high-density polyethylene (HDPE), and so forth.

A moisture permeability property in a storing bag used for the present invention was measured according to the standard of JIS K7129 B method. The measured water vapor permeability is preferably not more than 1 $g/m^2/day$, and more preferably less than 0.1 $g/m^2/day$. This water vapor permeability, for example, can be measured under the conditions of 37° C. and 90% RH employing a water vapor permeability measuring apparatus PERMATRAN-W1A.

Moisture permeability can also be measured according to the standard of JIS Z 0208 or ASTM E96. After a test specimen having a thickness of 25 μm is fixed in a cup containing desiccant, and remains untouched in a specified constant temperature and humidity apparatus for a given period of time, a weight change before and after absorption with the desiccant is measured by the method. Materials selected from plastic materials having the moisture permeability of not more than 20 $g/m^2 \cdot 24$ hr at 25 μm in thickness under normal pressure at 40° C. and 90% RH are preferably used in these methods. The moisture permeability of the plastic materials is preferably 0.01-20 $g/m^2 \cdot 24$ hr, and more preferably 0.01-10 $g/m^2 \cdot 24$ hr.

Similarly, oxygen permeability as an indicator of air permeability is preferably not more than 1.0 $ml/m^2/d$, and more preferably 0.5 $ml/m^2/d$. The oxygen permeability can be measured at 23° C. and 0% RH with an oxygen permeability measuring apparatus OX-TRAN100 manufactured by Modern Control Kabusiki Kaisha.

An ink bag, wherein a light shielding layer is composed of two kinds of layers of an aluminum layer and a resin layer containing a light shielding material is described in Structure 5. In the case of two layers utilized for a light shielding layer, it is preferred in view of light shielding, productivity, and cost performance that one is an aluminum layer, and the other is a resin layer containing a light shielding material. Polyethylene containing carbon black, and the like are provided as the resin containing a light shielding material.

Provided as commercially available products for the light shielding are No. 45 and No. 950 manufactured by Mitsubishi Chemical Corporation, VALCAN-P manufactured by Cabot Co., Ltd., DENKABLACK manufactured by Denki Kagaku Kogyo Kabushiki Kaisha), and PEX 9860 20 manufactured by Tokyo Printing Ink MFG. Co., Ltd.

The addition amount is preferably 0.3-0.6% by weight, and more preferably 0.35-0.40% by weight in view of the film properties and the light shielding property.

An ink bag, wherein a protective layer containing nylon or polyester is provided on the outer side of the light shielding layer is described in Structure 6. It is preferred that a protective layer is provided on the outer side of the light shielding layer in order to protect the light shielding layer. Nylon or polyester is preferably employed as the material, and polyethylene terephthalate or polyethylene naphthalate is preferably used as polyester. The thickness is preferably 5-100 μm, and more preferably 5-50 μm.

An ink bag, wherein an ink resistance layer contains nylon or polyester is described in Structure 7. It is preferable that polyester exhibits an anti-impact property and a mechanical strength property. It is preferred that the ink resistance layer containing polyester is adjacently provided to the light shielding layer in order to add to the mechanical strength of the light shielding layer. Nylon exhibiting an oil resistance property is also preferable.

An ink bag, wherein a heat sealing layer contains polyethylene is described in Structure 8. Polyethylene is preferably used as the materials exhibiting an excellent heat sealing property as well as an appropriate resistance property to the UV curable ink. The thickness is 10-100 μm, and preferably 12-75 μm. Polyethylene used for the heat sealing layer was analyzed via Gel Permeation Chromatography (G.P.C). It is preferred that a low molecular weight component is not more than 3% by weight in the measured molecular weight.

Since a heat sealing layer touches ink, a weight changing rate is preferably not more than 5% by conducting an immersion test.

A light shielding material such as carbon black or so forth is contained in the heat sealing layer, whereby the heat sealing layer serves for a light shielding layer.

A Polyethelene layer having a thickness of 10-50 μm is preferably provided between the heat sealing layer and the light shielding layer for buffering against impact.

Provided for a heat sealing layer are low-density polyethylene (LDPE), high-density polyethylene (HDPE), linear low-density polyethylene (LLDPE), medium-density polyethylene, non-oriented polypropylene (CPP), oriented polypropylene (OPP), oriented nylon (ONy), polyester (PET), cellophane, polyvinyl alcohol (PVA), oriented vinylon (OV), ethylene-vinyl acetate copolymer (EVA), vinylidene chloride (PVDC) and so forth, which are polymeric films used as general packaging materials (those described, for example, by Toray Research Center Inc., the new development corporation of functional packaging materials).

These thermoplastic films can also be used as a multilayer film formed via coextrusion with foreign films or a multilayer film formed by laminating with a stretching angle varied, if desired. Low-density polyethylene (LDPE), linear low-density polyethylene (LLDPE), or LDPE and LLDPE produced by using a metallocene catalyst, and a film obtained by using a mixture of these films and a high-density polyethylene (HDPE) film are preferred as a thermoplastic film on the side touching ink of the heat sealing layer. It is also possible to be produced via a combination of density and molecular weight distribution of a film used to acquire matter properties of further desired packaging materials.

An ink bag, wherein polyethylene used for the heat sealing layer is polyethylene prepared employing a metallocene catalyst is described in Structure 9. Polyethylene prepared employing a metallocene catalyst is preferably used, since its heat sealing strength is high.

Particularly, among them, in view of melting temperature and strength, LLDPE prepared employing a metallocene catalyst is preferred and commercially available products may adequately be used. The metallocene means a compound having a chemical structure in which a transition metal is put between unsaturated cyclic compounds, and commonly known is a combination of a Zr complex and methylaluminoxan (MAO). This catalyst is called Kaminsky catalyst or Kaminsky-sinn catalyst. Provided as commercially available products, for example, are UMERIT manufactured by Ube Industries Ltd., AFFINITY and ELITE manufactured by Daw Chemical Co., Ltd., HARMOREX LL manufactured by Japan Polyolefin Co., Ltd., CARNEL 57L manufactured by Japan Plychem Co., Ltd., EVOLU manufactured by Mitsui Chemical Inc, LAMILON SUPER manufactured by Sekisui Chemical Co., Ltd., SE SERIES manufactured by Tama Poli Co., Ltd., TOHCELLO T.U.X-FCS and T.U.X-TCS manufactured by Tohcello Co., Ltd., TAIKO FL manufactured by Futamura Chemical Co., Ltd., METALLO ACE manufactured by Mitsubishi Chemical Kohjin PAX Co., Ltd., WMX manufactured by Wada Chemical Industries Co., Ltd., FV202 manufactured by Sumitomo Chemical Co., Ltd., and the like.

Provided as the material used for each layer are polyethylene (PE), polypropylene (PP), Polystyrene (PS), polymethyl methacrylate (PMMA), biaxially oriented nylon 6, polyethylene terephthalate (PET), polycarbonate (PC), polyimide, polyether styrene (PES), and inorganic films described in "Thin Film Handbook" (p 879-901) edited by Japan Society for the Promotion of Science, "Shinku Gijutsu Handbook" (p 502-509, p 612, and p 810) edited by Nikkan Kogyo Shimbun, Ltd., and "Shinku Handbook extra edition" (p 132-134) edited by ULVAC, Inc.

Multi-layer plastic sheets prepared by laminating plural plastic sheets can be employed. Provided as the plastic sheets having a multi-layered structure, for example, are a three-layer structure of polyethylene terephthalate/polyvinyl alcohol•ethylene copolymer/polyethylene, a three-layer structure of oriented polypropylene/polyvinyl alcohol•ethylene copolymer/polyethylene, a three-layer structure of non-oriented polypropylene/polyvinyl alcohol•ethylene copolymer/polyethylene, a three-layer structure of nylon/aluminum foil/polyethylene, a three-layer structure of polyethylene terephthalate/aluminum foil/polyethylene, a four-layer structure of cellophane/polyethylene/aluminum foil/polyethylene, a three-layer structure of aluminum foil/paper/polyethylene, a four-layer structure of polyethylene terephthalate/polyethylene/aluminum foil/polyethylene, a four-layer structure of nylon/polyethylene/aluminum foil/polyethylene, a four-layer structure of paper/polyethylene/aluminum foil/polyethylene, a four-layer structure of polyethylene terephthalate/aluminum foil/polyethylene terephthalate/polypropylene, a four-layer structure of polyethylene terephthalate/aluminum foil/polyethylene terephthalate/high-density polyethylene, a four-layer structure of polyethylene terephthalate/aluminum foil/polyethylene/low-density polyethylene, a double-layered structure of polyvinyl alcohol•ethylene copolymer/polypropylene, a three-layer structure of polyethylene terephthalate/aluminum foil/polypropylene, and a three-layer structure of paper/aluminum foil/polyethylene. Preferably provided are a four-layer structure of polyethylene/polyvinylidene chloride coated nylon/polyethylene/ethylvinyl acetate•polyethylene condensation product, a three-layer structure of polyethylene/polyvinylidene chloride coated nylon/polyethylene, a five-layer structure of ethylvinyl acetate•polyethylene condensation product/polyethylene/polyethylene/aluminum evaporated nylon/polyethylene/ethylvinyl acetate•polyethylene condensation product, a four-layer structure of aluminum evaporated nylon/nylon/polyethylene/ethylvinyl acetate•polyethylene condensation product, a three-layer structure of oriented polypropylene/polyvinylidene chloride coated nylon/polyethylene, a five-layer structure of polyethylene/polyvinylidene chloride coated nylon/polyethylene/polyvinylidene chloride coated nylon/polyethylene, a three-layer structure of oriented polypropylene/polyvinyl alcohol•ethylene copolymer/low-density polyethylene, a three-layer structure of oriented polypropylene/polyvinyl alcohol•ethylene copolymer/non-oriented polypropylene, a three-layer structure of polyethylene terephthalate/polyvinyl alcohol•ethylene copolymer/low-density polyethylene, a three-layer structure of oriented nylon/polyvinyl alcohol•ethylene copolymer/low-density polyethylene, and a three-layer structure of non-oriented nylon/polyvinyl alcohol•ethylene copolymer/low-density polyethylene.

It is preferred that undercoat treatment, plasma treatment, or corona treatment is carried out in order to enhance each interlayer adhesiveness. Provided as an adhesive is SEIKABOND A-158W/C-90 manufactured by Dainichiseika Color & Chemicals Mfg. Co., Ltd.

(UV Curable Ink)

UV curable ink to be filled in an ink bag of the invention contains polymerizable compounds and polymerization initiators, and coloring material, polymerization-inhibitor, surfactants, resins and solvents are blended therein, as occasion demands.

As radically polymerizable ink, ink compositions disclosed in, for example, Japanese Patent O.P.I. Publication No. 7-159983, Japanese Patent O.P.I. Publication No. 7-31399 and Japanese Patent O.P.I. Publication Nos. 8-224982 and 10-863 can be given, and as cationic polymerization ink, various known ink compositions can be used. For example, there are given Japanese Patent O.P.I. Publication No. 6-9714 and Japanese Patent O.P.I. Publication Nos. 2001-31892, 2001-40068, 2001-55507, 2001-310938, 2001-310937, 2001-220526 and 2004-131588.

(Structure of Ink Bag)

FIG. 1 is a perspective view of an ink bag. Ink bag 3 has two members including ink storage portion 301 and ink outlet portion 302. A top surface of the ink storage portion 301 is represented by 301*a* and a bottom surface of the ink storage portion 301 is represented by 301*b*. Sealing portions for forming the ink storage portion 301 are represented by 301*c* and 301*d*. The sealing portion 301*c* shows a sealing portion in the case of forming the ink storage portion 301 through center sealing method.

Incidentally, a shape of the ink storage portion 301 is not limited because it varies depending on a method of making it, and for example, two sheets of materials may be superposed to be sealed on three sides to be in a form of a bag, or a sheet of material may be folded double to be sealed on two sides to be in a form of a bag.

A base material of ink outlet portion 302 is represented by 302*a*. A connecting portion with ink storage portion 301 provided on the base material 302*a* is represented by 302*b*. With respect to a method to connect the ink storage portion 301 with the connecting portion 302*b*, the connecting portion 302*b* is inserted in the ink storage portion 301, and then, they are adhered together through thermal adhesion or by adhesives. A sealing portion where the ink storage portion 301 is connected with the connecting portion 302*b* is represented by 301*e*.

The numerical symbol 302*c* represents an attaching portion where an ink jet recording device is attached to an ink supplying portion (unillustrated). A cylindrical ink output port provided on 302*c* is represented by 302*d*. Meanwhile, a front portion of the ink storage portion 301 is located on the side where the ink outlet portion 302 is attached on the ink storage portion 301, while, the rear portion thereof is located on a side that is opposite to the side where the ink outlet portion 302 is attached. The reverse side of the ink outlet portion 302 is a side where the connecting portion 302*b* is attached, while, the obverse side thereof is a side that is opposite to the reverse side.

Figure 2:
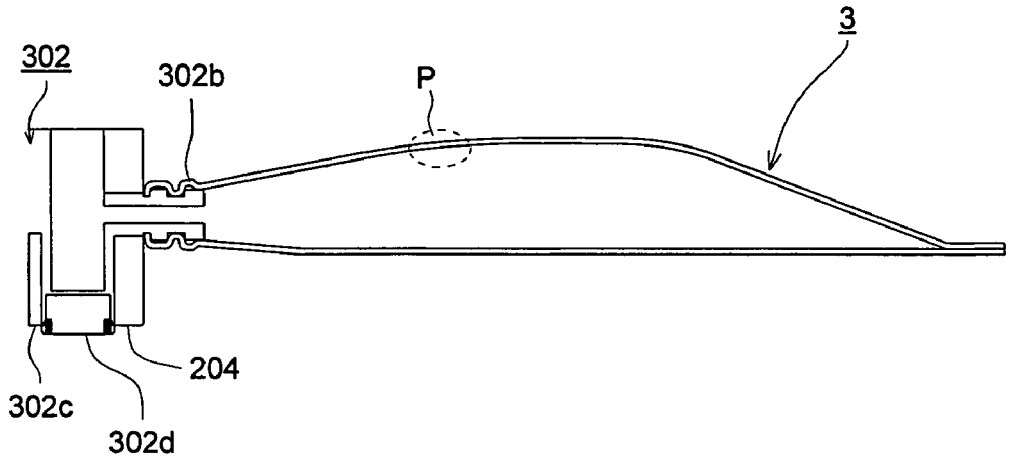
FIG. 2 is a schematic cross-sectional view of the ink bag in FIG. 1.

FIG. 2 is a schematic cross-sectional view of the ink bag shown in FIG. 1. In FIG. 2, the numeral 204 represents a cut-out portion that is provided for connecting the ink output port 302*d* to the ink supplying portion (unillustrated) of the ink jet recording device, when the ink bag is attached to the ink supplying portion (unillustrated) of the ink jet recording device. Other symbols are synonymous with those in FIG. 1.

Figure 3:
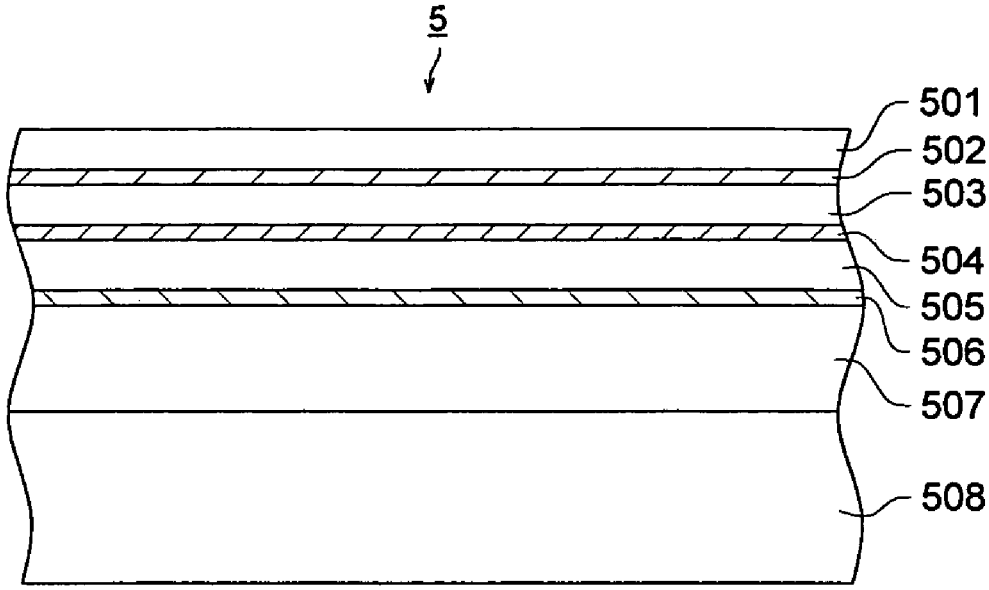
FIG. 3 is an enlarged schematic cross-sectional view of a portion indicated by a symbol of P in FIG. 2.

FIG. 3 is an enlarged schematic cross-sectional view of a multiplayer film in a portion shown with symbol P in FIG. 2 composed of protective layer 501, adhesive layer 502, first light shielding layer 503, adhesive layer 504, ink resistance layer 505, anchor coat layer 506, buffer layer 507 and heat sealing layer 508 serving also as a second light shielding layer.

(Manufacture of Ink Bag)

In a method to manufacture an ink bag shown in FIG. 1, a cylindrical ink storage portion is made first by using a multiplayer film shown in FIG. 3, then, after fitting an outlet portion on one side of an opening, ink is filled in the ink storage portion through the other opening under the condition of decompression, and the aforesaid opening is adhered by the way of thermal adhesion or by adhesives, thereby, an ink bag can be manufactured.

As a method for making a cylindrical ink storage portion, there are considered, for example, the following methods including (1) a method to adhere long sides of the two rectangular multiplayer thermoplastic films by the way of thermal adhesion or by adhesives, (2) a method to fold double a sheet of the rectangular thermoplastic film at the center in its longitudinal direction and to adhere both long sides by the way of thermal adhesion or by adhesives and (3) a method to fold double a sheet of the rectangular thermoplastic film at the center in its lateral direction and to adhere a long side by the way of thermal adhesion or by adhesives, and the easiest method among the foregoing can be selected properly.

In a method to fit the ink outlet portion, it is possible to fit by inserting the connecting portion mounted on the base material of the ink outlet portion into the ink storage portion, then, by adhering them by the way of thermal adhesion or by adhesives.

EXAMPLE

Next, the present invention will be specifically explained employing examples, but the present invention is not limited thereto.

Example 1

[Preparation of Ink Bag]

(Ink Bag 1)

Ink bag 1 of the present invention was prepared employing the following materials.

A complex film used for an ink bag made of a flexible packing material containing PET No. 12/DL/AL12 (T-120)/DL/ONY No. 15/AC/PE30/BLACK PE50 was prepared. Each of the above materials is detailed below.

<PET No. 12>

A PET film having a thickness of 12 μm and a weight changing rate of not more than 1% obtained in an ink immersion test will be a protective layer.

The weight changing rate was measured as described below.

After a member is preserved for 24 hours under the normal conditions of 23° C. and 50% RH, a weight is measured. Next, the member is immersed in ink filled in a bag, sealed, and preserved at 60° C. for a week. The member is subsequently taken out, and washed with aceton. Then, the member is preserved for 24 hours under the normal conditions of 23° C. and 50% RH, a weight is measured to acquire a weight changing rate. The weight changing rate calculated via weight measuring before and after the immersion process.

<DL>

The adhesion process was conducted using a dry-laminate of SEIKABOND A-158W/C-90 manufactured by Dainichiseika Color & Chemicals Mfg. Co., Ltd.

<AL12 (T-120)>

AL12 (aluminum foil) having a thickness of 12 μm against moisture permeability was employed. An aluminum foil also tends to be easily torn. Since an ink bag of 3-4 L is rubbed with the inside wall of the outer box, so that a pinhole appears easily, a composite film combined with a T-120 Fe system alloy having high strength and excellent bending properties is employed. This is for the first light shielding layer.

<ONY No. 15>

This is a biaxially oriented nylon film having a thickness of 15 μm and a weight changing ratio of not more than 1% via an ink immersion test, and exhibits an oil resistance property to block an oily substance, accompanied with an anti-corrosion property. This is for an ink resistance layer.

<AC>

Surface treatment (anchor coating) was conducted to enhance adhesion.

<PE30>

This is a polyethylene film having a thickness of 30 μm. A-tear of an ink bag caused by a fall is prevented via buffering against impact.

<BLACK PE50>

This is a polyethylene film, into which carbon black is kneaded, having a thickness of 50 μm and a weight changing ratio of 1-5% via an ink immersion test. This polyethylene is linear low-density polyethylene polymerized by using a metallocene catalyst (linear low-density polyethylene FV202 manufactured by Sumitomo Chemical Co., Ltd.), and its molecular distribution is constant, coupled with high strength. This is for a heat sealing layer which serves for the second light shielding layer.

The above-mentioned composite film was used and the black PE50 was provided on the inner surface. After the ink storage portion (for 4 L) in FIG. 1 was heat-treated in the form of spouting by a thermal adhesion technique, an ink supplying portion, made of low-density polyethylene, having the configuration of FIG. 1, which was prepared via injection molding, was provided to prepare ink bag 1.

(Ink Bag 2)

A composite film used for a flexible packing material ink bag containing AL12(T-120)/DL/BLACK PE50 was prepared. Ink bag 2 of the comparative example was prepared, similarly to ink bag 1 employing this film. In addition, an ink resistance layer having a weight changing rate of not more than 1% is not used in this case.

[Evaluation of Ink Bag]

A cationic polymerization type UV curable ink of 3 L having the following composition was filled in a prepared ink bag having an inner volume of 4 L, and sealed at 110° C. via heat-sealing while reducing pressure, to prepare ink bags 1 and 2 in which ink was filled. A dry air could be controlled to not more than 5 mL via reduced pressure packing.

(Preparation of UV Curable Ink)

<Cyanogen Pigment Dispersed Substance>

| | |
|---|---|
| PB 15:3 | 15 parts by weight |
| Dispersant | 2 parts by weight |
| ARONOXETANE OXT-221 (manufactured by Toagosei Co., Ltd.) | 83 parts by weight |

Subsequently, The following composition was subsequently arranged, filtrated with a membrane filter of 0.8 μm, and dehydrated at reduced pressure while heating up to 50° C., to acquire the UV curable ink (cyanogen).

<Ink Composition>

| | |
|---|---|
| INK pigment dispersed substance | 17 parts by weight |
| ARONOXETANE OXT-221 (manufactured by Toagosei Co., Ltd.) | 70 parts by weight |
| CELLOXIDE 2021P (manufacture by Daicel UCB Kabushiki Kaisha) | 30 parts by weight |
| Photoacid generator UVI-6990 (manufactured by Dow Chemical Company) | 5 parts by weight |

The following items were evaluated by employing an ink bag in which this ink was filled.

(Ink Storing Property)

An ink bag, in which ink was filled, was stored at 70° C. for two weeks, and viscosity and a change in average diameter of pigment particles (changing rate) before and after storing the ink was measured by a commonly known method. The evaluation criteria is shown below.

A: Changing rates in viscosity and average particle diameter are less than 3%.

B: Changing rates in viscosity and average particle diameter are not less than 3%.

(Strength Test)

After an ink bag, in which ink was filled, was stored at 70° C. for two weeks, it was checked that a tear of a heat sealing layer can visually be observed or not be observed, when it fell from a height of 70 cm.

A: No tear was visually observed.

B: A tear was visually observed.

(Vibration Test)

A changing process in the range between 5-64 Hz which was conducted in 5 minutes was arranged to be set as one cycle, and after this cycle was repeated 6 times, employing vibration tester BF-UA (manufactured by IDEX Co., Ltd.) used for an ink bag in which ink was filled, the exterior of the ink bag was visually observed, and a mark in which ink was exuded via appearance of pinholes in an aluminum foil layer was evaluated by the following criteria.

A: No mark, in which ink was exuded, was visually observed.

B: A mark, in which ink was exuded, was visually observed.

(Ink Storing Property after Vibration Test)

A changing process in the range between 5-64 Hz which was conducted in 5 minutes was arranged to be set as one cycle, and after this cycle was repeated 6 times, employing vibration tester BF-UA (manufactured by IDEX Co., Ltd.) used for an ink bag in which ink was filled, and the ink bag remained untouched for 7 days. The ink bag was subsequently installed to an ink jet recording apparatus LF-1044SD manufactured by Konica Minolta, a continuous recording process was conducted in an A0 size for 10 minutes, and it was checked that ink extraction can visually be observed or not be observed, to be evaluated by the following criteria.

A: No ink extraction was visually observed.

B: Ink extraction was visually observed at one place or more.

The evaluated results are shown in Table 1.

TABLE 1

| Ink bag No. | Ink storing property | Strength test | Vibration test | Ink storing property after vibration test | Remarks |
|---|---|---|---|---|---|
| 1 | A | A | A | A | Present invention |
| 2 | A | B | B | B | Comparative example |

It is to be understood from Table 1 that the ink bag of the present invention is an ink bag exhibiting not only high sealing strength, but also satisfactory light shielding and ink resistance properties maintaining for a long period of time via no appearance of pinholes in a heat shielding member against external factors such as vibration and so forth, compared with the comparative example.

Effect of the Invention

An ink package accompanied with an ink bag, that exhibits satisfactory light shielding and ink resistance properties maintaining for a long period of time at low cost against external factors such as vibration and bending, employed via a UV curable ink jet recording method, can be provided in the present invention.

What is claimed is:

1. A UV curable ink package comprising (1) a bag formed with a multilayer and (2) a UV curable ink stored in the bag, wherein the multilayer contains (a) a light shielding layer and (b) an ink resistance layer having a weight changing rate of not more than 1% obtained via an immersion test, employing the UV curable ink that is to be stored in the bag.

2. The UV curable ink package of claim 1, wherein a heat sealing layer is provided on an inner surface of the ink resistance layer.

3. The UV curable ink package of claim 2, wherein the heat sealing layer contains polyethylene.

4. The UV curable ink package of claim 3, wherein the foregoing polyethylene is polyethylene prepared by using a metallocene catalyst.

5. The UV curable ink package of claim 1, wherein the light shielding layer is composed of not less than two layers.

6. The UV curable ink package of claim 5, wherein the light shielding layer is composed of two kinds of layers of an aluminum layer and a resin layer containing a light shielding material.

7. The UV curable ink package of claim 1, wherein the light shielding layer is an aluminum layer.

8. The UV curable ink package of claim 1, wherein a protective layer containing nylon or polyester is provided on an outer surface of the light shielding layer.

9. The UV curable ink package of claim 1, wherein the ink resistance layer contains nylon or polyester.

* * * * *